US005263505A

United States Patent [19]

Yeom

[11] Patent Number: 5,263,505

[45] Date of Patent: Nov. 23, 1993

[54] OBLONG UMBRELLA

[76] Inventor: Cheon J. Yeom, 201 Libera Villa, 179-3 Yoocheon-dong, Chung-ku, DaeJeon-Shi, Rep. of Korea

[21] Appl. No.: 36,527

[22] Filed: Mar. 24, 1993

[30] Foreign Application Priority Data

Jul. 10, 1992 [KR] Rep. of Korea ..... 92-12840
Oct. 16, 1992 [KR] Rep. of Korea ..... 92-20117

[51] Int. Cl.[5] ..... A45B 11/00

[52] U.S. Cl. ..... 135/20.1; 135/28; 135/29

[58] Field of Search ..... 135/16, 20.1, 29, 31, 135/33.2, 21, 27, 28, 32

[56] References Cited

U.S. PATENT DOCUMENTS

| | | | |
|---|---|---|---|
| 256,308 | 4/1882 | Forster | 135/20.1 |
| 1,093,160 | 4/1914 | Wagner | 135/20.1 |
| 1,824,192 | 9/1931 | Bouma | 135/27 X |
| 1,839,309 | 1/1932 | Gundel | 135/31 X |
| 3,464,431 | 9/1969 | Loeffler | 135/20.1 |
| 4,193,415 | 6/1989 | Hermanson . | |
| 4,274,429 | 6/1981 | Kinski | 135/20.1 |
| 4,433,699 | 2/1984 | Schultes et al. . | |
| 4,479,504 | 10/1984 | Harng . | |
| 4,586,525 | 5/1986 | Glatz et al. . | |
| 4,601,301 | 7/1986 | Hermanson . | |
| 4,641,675 | 2/1987 | Wu . | |
| 4,838,290 | 6/1989 | Wu . | |
| 5,193,565 | 3/1993 | Huang | 135/29 X |

FOREIGN PATENT DOCUMENTS

| | | | |
|---|---|---|---|
| 0602502 | 9/1934 | Fed. Rep. of Germany | 135/20.1 |
| 0055834 | 9/1910 | Switzerland | 135/20.1 |

*Primary Examiner*—Carl D. Friedman
*Assistant Examiner*—Lan M. Mai
*Attorney, Agent, or Firm*—Vidas, Arrett & Steinkraus

[57] ABSTRACT

An oblong umbrella having a hood adapted to be extended oppositely so as to shield several people and which is foldable and extendable in a bellows manner for convenient handling and storage. An umbrella comprises a main shaft, an upper hub secured to the main shaft, a lower runner slidably inserted on the main shaft, main spokes connected to the upper hub, main stretcher links connected to the lower runner at inner ends thereof and to middle parts of the main spokes at the outer ends thereof, two upper frames connected to the upper hub which are projected oppositely, two lower frames connected to the lower runner which are connected to middle parts of the upper frames at middle parts thereof, an upper hinge connected to outer ends of the lower frames, a lower hinge connected to outer ends of the upper frames, second spokes connected to the upper hinges, second stretcher links connected to the lower hinge and to middle parts of the second spokes, and a hood secured to outer ends of the main and second spokes. In another embodiment, a mediate runner is disposed between the upper hub and the lower runner. Two frames are pivotally connected to both sides of the mediate runner to form a X-shaped configuration. The frames are each connected at a middle part of a half thereof to the outer end of an upper stretcher link connected to the upper hub and at a middle part of the other half thereof to the outer end of a lower stretcher link connected to the lower runner.

10 Claims, 11 Drawing Sheets

OBLONG UMBRELLA

BACKGROUND OF THE INVENTION

Field of the Invention

The present invention relates to an umbrella, and more particularly to an oblong umbrella which has a hood adapted to be extended oppositely so as to shield several people and which is folded and extended in a bellows manner for convenient handling and storage.

In this specification, an umbrella according to the invention is not necessarily limited to an usual umbrella and can be also applicable to a parasol and a beach umbrella. Hence, umbrellas of the above kinds will be referred generically as a term "umbrella" for convenience hereinafter with the exception of particular case.

Referring to FIG. 1, there is shown a conventional umbrella. As shown in the drawing, the umbrella comprises a main central shaft 100, a plurality of main links 101 pivotally secured to an upper end of the main shaft 100 at inner ends thereof, a plurality of stretcher links 102 pivotally secured to a middle portions of the main links 101 and a cloth or a hood 103 secured on the main links 101.

When the umbrella is extended, the cloth 103 has a round shape in plane and the central shaft 100 is projected vertically relative to the cloth 103 so that the umbrella can serve to shield only one person.

However, since the central shaft 100 is located at a center of the cloth 103, a user is easily soaked at his shoulder and arm portions during working in a storm weather. Also, in case of a beach umbrella, user is easy to be exposed to direct rays of the sun.

In order to overcome the above-mentioned problems, when the umbrella is enlarged in its cloth, it is difficult for the links and the associated components are difficult to support the cloth so that the umbrella is limited in its size.

SUMMARY OF THE INVENTION

Therefore, an object of the present invention is to overcome the above-mentioned disadvantages encountered in the prior arts and to provide an umbrella in which a cloth is enlarged into an oblong form to shield several people against rain or direct rays of the sun, and the links and associated components are reduced in weight as compared with its enlarged size and strengthened sufficiently to support the enlarged cloth.

In accordance with an embodiment of the present invention, these objects can be accomplished by providing an oblong umbrella comprising: a main straight shaft having a handle at its lower end; an upper hub assembly secured to an upper end of the main shaft which is pivotally connected to inner ends of two upper frames projecting oppositely therefrom and pivotally connected to inner ends of a plurality of main spokes; a lower runner assembly which has a main runner slidably inserted on the main shaft and a sub-runner slidably inserted on the main runner, the main runner being pivotally connected to inner ends of a plurality of stretcher links and the sub-runner being pivotally connected to inner ends of two lower frames projecting oppositely therefrom, the stretcher links being pivotally connected to middle portions of the main spokes, each of the lower frames being intersected with each of the upper frames to form X-shaped configuration and connected to the intersected portion of the upper frame by means of a hinge pin; upper hinge portions each of which is pivotally connected to an outer end of the lower frame and inner ends of a plurality of second spokes; lower hinge portions each of which is pivotally connected to an outer end of the upper frame and inner ends of second stretcher links, the second stretcher links being pivotally connected to middle portions of the second spokes at outer ends thereof; and an oblong cloth secured to outer ends of the main spokes and the second spokes at its outer periphery.

In accordance with another embodiment of the invention, the present invention provides an oblong umbrella comprising: a main straight shaft having a handle at its lower end; an upper hub assembly secured to an upper end of the main shaft which is pivotally connected to inner ends of two upper stretcher links and a plurality of main spokes, the two upper stretcher links projecting oppositely to each other; a mediate runner slidably inserted on the main shaft under the upper hub assembly which is pivotally connected to middle portions of first and second frames and at its both sides, the upper stretcher links each being pivotally connected to a middle portion of a half of either of the first and second frames; a lower runner assembly slidably inserted on the main shaft under the mediate runner which has an upper runner, a middle runner, a lower runner, an upper compression spring interposed between the upper runner and the middle runner and a lower compression spring interposed between the middle runner and the lower runner, the upper runner being pivotally connected to inner ends of main stretcher links each pivotally connected to a middle portion of the main spoke, the middle runner being pivotally connected to inner ends of lower stretcher links each pivotally connected to a middle portion of the other half of either of the first and second frames and to inner ends of upper sub-links each pivotally connected to a middle portion of the main stretcher link, the lower runner being pivotally connected to inner ends of lower sub-links each pivotally connected to a middle portion of the lower stretcher link; upper hinge portions each of which is pivotally connected to an end of the half of either of the first and second frames and a plurality of second spokes; lower hinge portions each of which is pivotally connected to an end of the other half of either of the first and second frames and second stretcher links each pivotally connected to a middle portion of the second spoke; and an oblong cloth secured to outer ends of the main and second spokes at its periphery.

BRIEF DESCRIPTION OF THE DRAWINGS

Other objects and advantages of the present invention will become apparent from the following description of embodiments with reference to the accompanying drawings in which.

DETAILED DESCRIPTION OF THE PREFERRED EMBODIMENTS

An umbrella according to preferred embodiment of the present invention will now be described by referring to the accompanying drawings.

Figure 1:
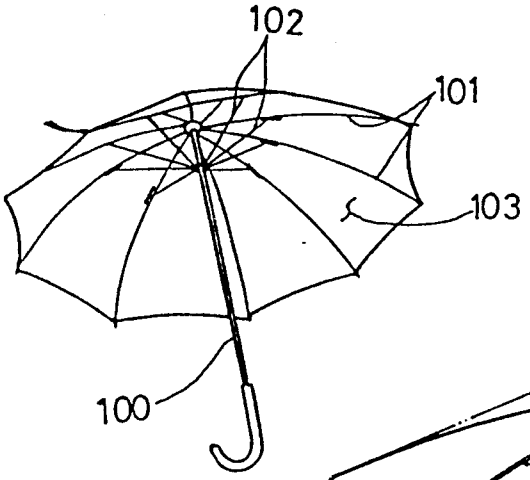
FIG. 1 is a perspective view of a conventional umbrella when viewed from its bottom.
Figure 2:
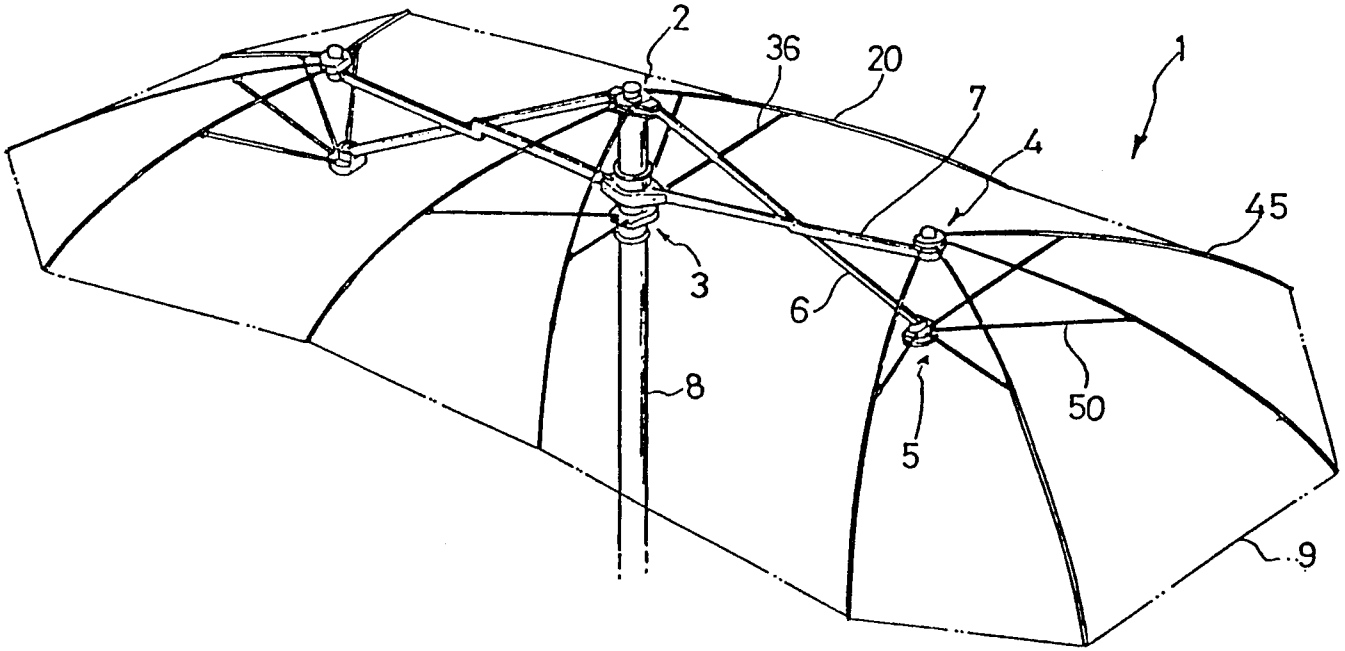
FIG. 2 is a perspective view of an umbrella according to a preferred embodiment of the present invention.
Figure 3:
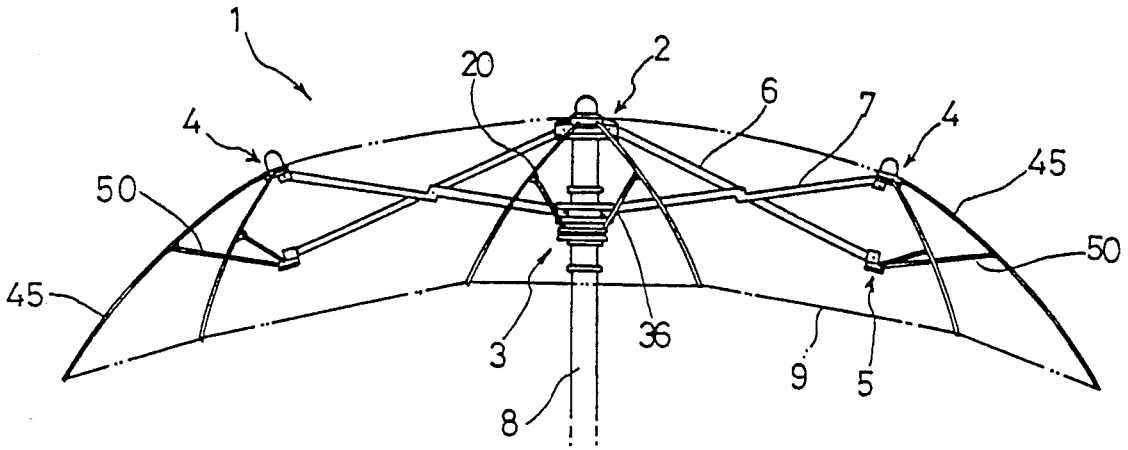
FIG. 3 is a front view of FIG. 1.

Referring to FIGS. 2 and 3, there are shown an umbrella according to an embodiment of the invention. As shown in the drawings, the umbrella 1 of the invention which is extended and folded in a bellows manner comprises a main straight shaft 8 having a handle (not shown) at its lower end, an upper hub assembly 2 secured to an upper end of the main shaft 8 which is pivotally connected to inner ends of two upper frames 6 projecting oppositely therefrom and pivotally connected to inner ends of a plurality of main spokes 20 (see FIG. 8A), a lower runner assembly 3 which has a main runner 31 slidably inserted on the main shaft 8 and a sub-runner 30 slidably inserted on the main runner 31, the main runner 31 being pivotally connected to inner ends of a plurality of stretcher links 36 and the sub-runner 30 being pivotally connected to inner ends of two lower frames 7 projecting oppositely therefrom, the stretcher links 36 being pivotally connected to middle portions of the main spokes 20, each of the lower frames 7 being intersected with each of the upper frames 6 to form X-shaped configuration and connected to the intersected portion of the upper frame 6 by means of a hinge pin (see FIG. 8B), upper hinge portions 4 each of which is pivotally connected to an outer end of the lower frame 7 and inner ends of a plurality of second spokes 45 (see FIG. 12), lower hinge portions 5 each of which is pivotally connected to an outer end of the upper frame 6 and inner ends of second stretcher links 50, the second stretcher links 50 being pivotally connected to middle portions of the second spokes 45 at outer ends thereof (see FIG. 13), and an oblong cloth 9 secured to outer ends of the main spokes 20 and the second spokes 45 at its outer periphery.

Figure 8A:
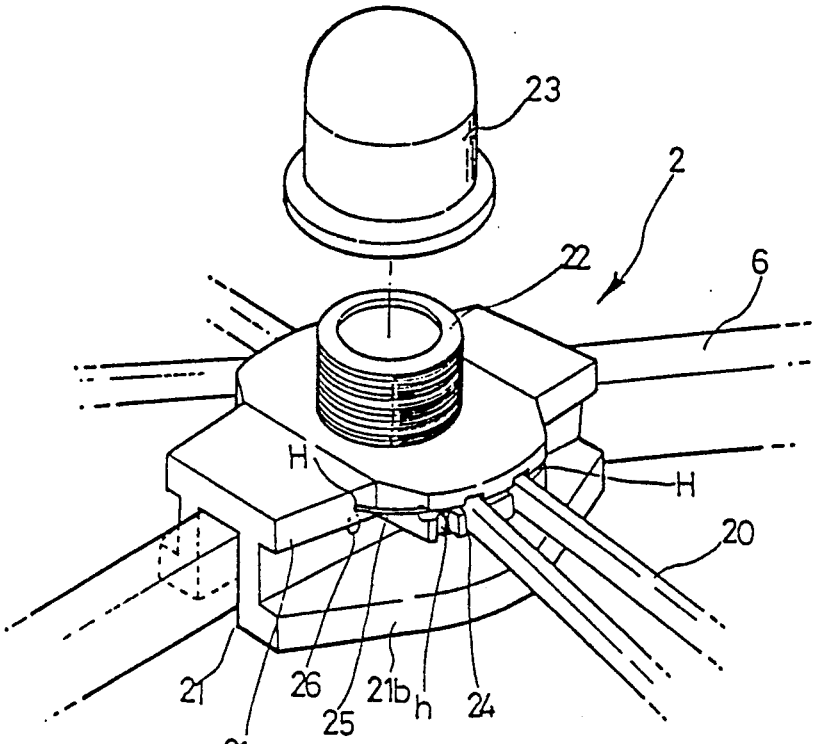
FIG. 8A is a perspective view of an upper hub assembly of the invention.
Figure 9:
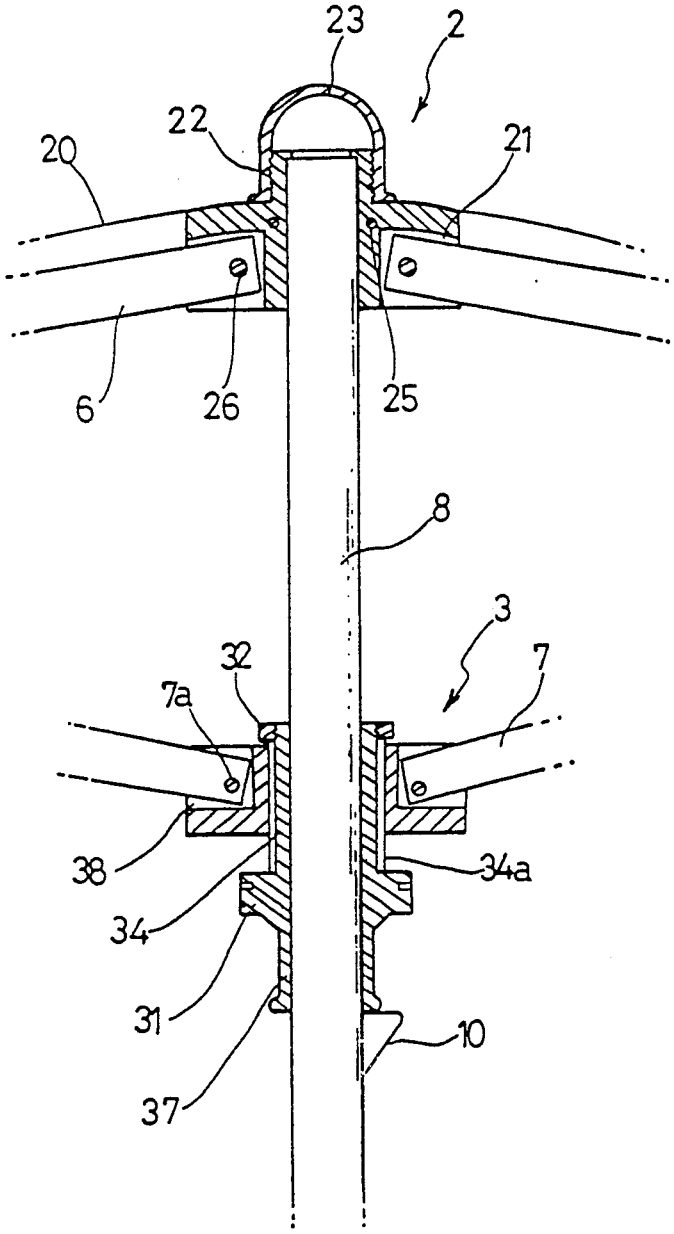
FIG. 9 is a sectional view of the upper hub assembly of FIG. 8A and the lower runner assembly of FIG. 8B which are assembled.

Referring to FIGS. 8A and 9, there are shown the upper hub assembly 2 of the invention. The upper hub assembly 2 is provided at its upper surface with a cylinder member 22 having an outer thread. The cylindrical member 22 is engaged with a cap 23 having an inner thread with the cloth 9 interposed therebetween so that the cloth 9 is secured to the upper hub assembly at its central portion. Also, the upper hub assembly 2 is provided with upper and lower horizontal projections 21*a* and 21*b* at its both sides. The upper hub assembly 2 is formed at its opposite ends with grooves 21 and 21 opening outward and downward. The inner ends of the upper frames 6 each is inserted into each of the grooves 21 and pivotally connected to the upper hub assembly 2 by means of a hinge pin 26.

Each of the upper projections 21*a* of the upper hub assembly 2 is formed at its outer periphery with a plurality of notches 24 opening outward and downward and formed with a peripheral wire grooves "H" intersecting with the notches 24. The main spokes 20 are inserted into the notches 24 at inner ends thereof. A hinge wire 25 passes through holes formed at inner ends of the main spokes 20 and inserted into the peripheral wire grooves "H". The knot of hinge wire 25 is concealed in a recess "h" formed at the upper projection 21*a*.

In this case, since the notches 24 open outward and downward, the main spokes 20 can not be turned above a horizontal plane but can be turned downward.

Figure 8B:
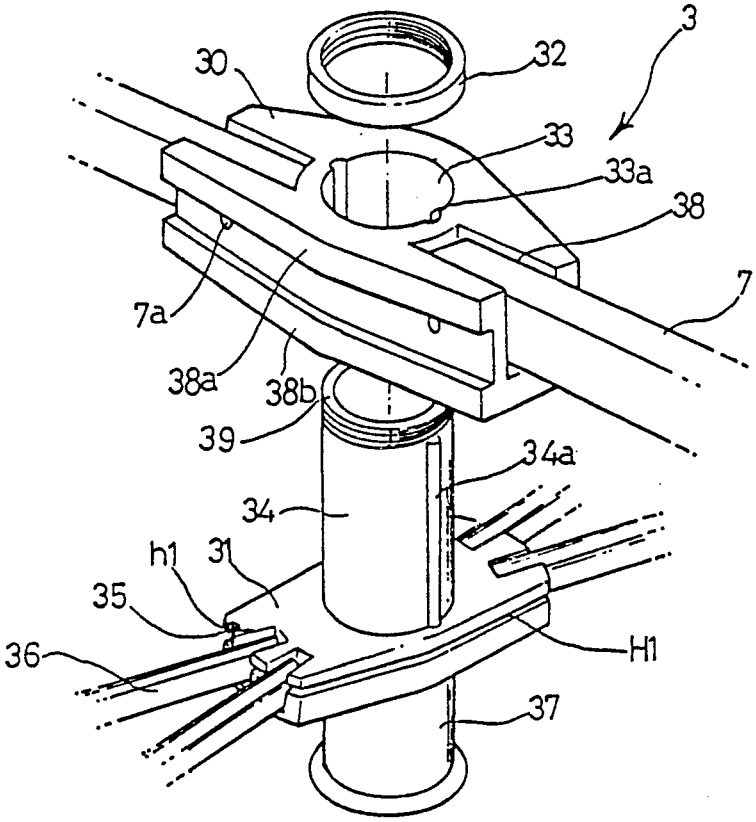
FIG. 8B is an exploded perspective view of a lower runner assembly of the invention.
Figure 10:
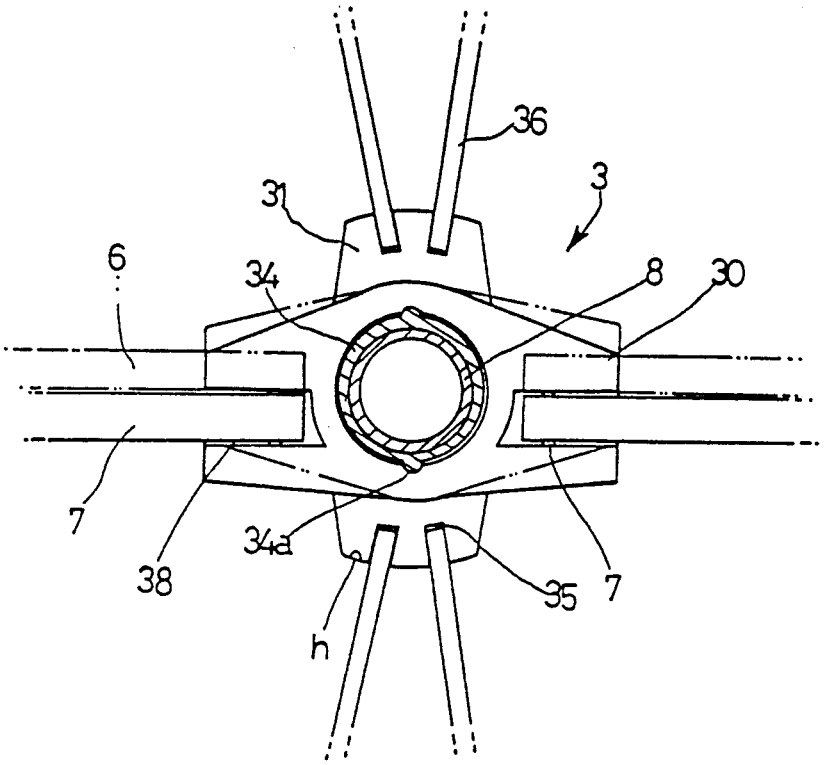
FIG. 10 is a plan view of FIG. 8B which is assembled.

Referring to FIGS. 8B, 9 and 10, there are shown the lower runner assembly 3 of the invention. The lower runner assembly 3 is slidably inserted on the main shaft 8 of the umbrella 1. The lower runner assembly 3 comprises the main runner 31 and the sub-runner 30. The main runner 31 is integrally formed with an upper guide cylinder 34 and a lower guide cylinder 37. The upper guide cylinder 34 is formed with an outer thread 39 at its upper end and formed with a pair of longitudinal guide rails 34*a* at its both sides. The outer thread 39 of the upper guide cylinder 34 is engaged with a retaining ring 32 having an inner thread in order to prevent the sub-runner 30 from being separated therefrom. Also, the main runner 31 is formed at its opposite ends with a plurality of notches 35 opening outward and upward and formed at its periphery with a peripheral wire groove "H1". The inner ends of the stretcher links 36 are inserted into the notches 35. A hinge wire (not shown) passes through holes formed at the inner ends of the stretcher links 36 and inserted into the peripheral wire groove "H1". A knot of the hinge wire is also concealed in a recess "h1" formed at the periphery of the main runner 31. Similarly to the upper hub assembly 2, since the notches 35 of the main runner 31 open outward and upward, the stretcher links 36 inserted the notches 35 can not be turned downward but can be turned upward.

The sub-runner 30 is formed with a central guide hole 33 corresponding to the upper guide cylinder 34 of the main runner 31 and the guide hole 33 is formed at its both sides with guide grooves 33*a* each corresponding to each of the guide rails 34*a* of the guide cylinder 34 so that the sub-runner 30 is slidably inserted on the upper guide cylinder 34 through its guide hole 33. The sub-runner 30 is provided with upper and lower projections 38*a* and 38*b* at its both sides. The sub-runner 30 is also formed at its opposite ends with grooves 38 opening outward and upward. The inner ends of the lower frames 7 are inserted into the grooves 38 of the sub-runner 30 and pivotally connected to the sub-runner 30 by means of hinge pins 7*a*. The assembled lower runner assembly 3 may be located on a locker plate 10 (see FIG. 9) mounted at an upper portion of the main shaft 8 when the umbrella 1 is completely extended.

Figure 12A:
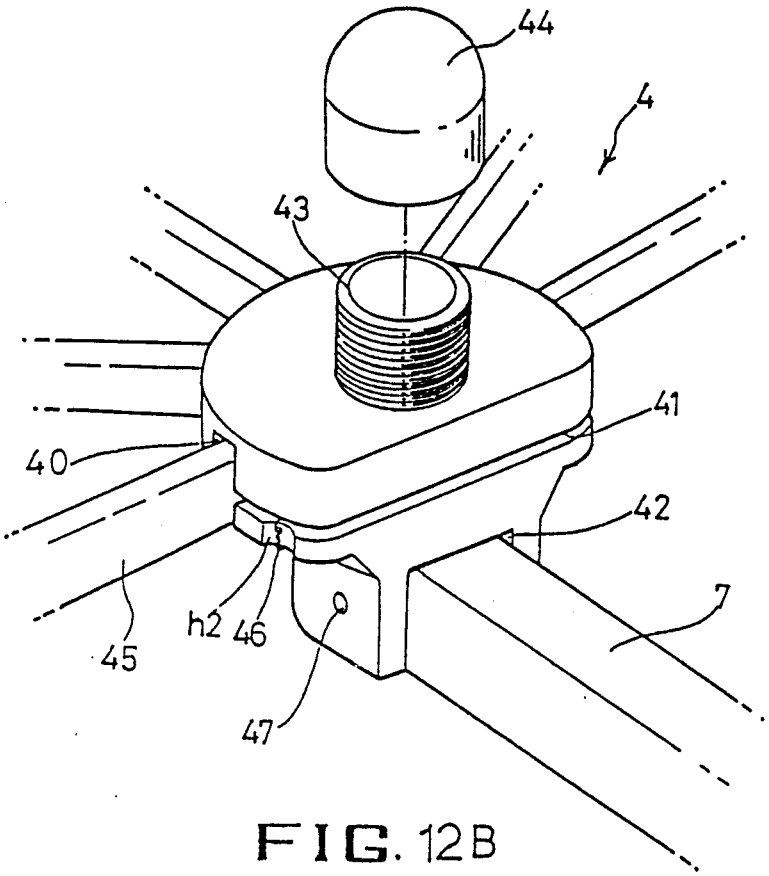
FIG. 12A is a perspective view of an upper hinge portion of the invention.
Figure 12B:
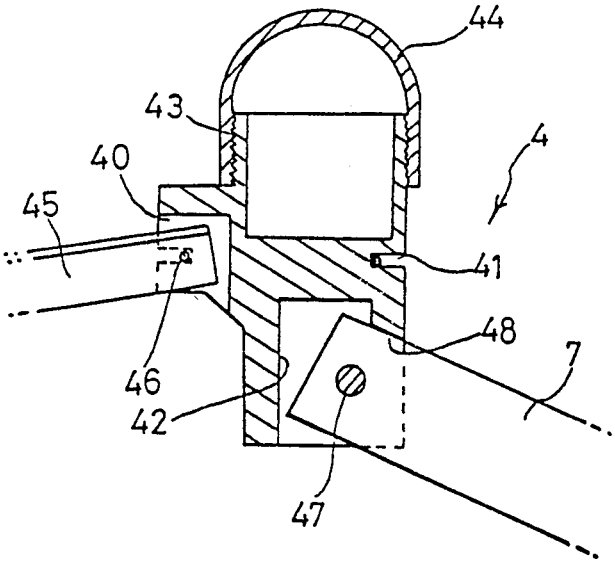
FIG. 12B is a sectional view of FIG. 12A.

Referring to FIGS. 12A and 12B, there are shown the upper hinge portion 4 of the invention. The upper hinge portion 4 is provided at its upper surface with a cylinder member 43 having an outer thread. The cylindrical member 43 is engaged with a cap 44 having an inner thread with the cloth 9 interposed therebetween so that the cloth 9 is secured to the upper hinge portion 4. The upper hinge portion 4 is formed at its outer periphery with a plurality of notches 40 opening outward and downward. The radial distribution of the notches 40 of a top view thereof may occupy an area of about half a circle of the upper hinge portion 4. The upper hinge portion 4 is formed at its periphery with a wire groove 41 intersecting with the notches 40. The inner ends of the second spokes 45 are inserted into the notches 40 and passed through by a hinge wire 46 inserted in the wire groove 41. The knot of hinge wire 46 is concealed in a recess "h2" formed at the periphery of upper hinge portion 4. The upper hinge portion 4 is formed at its lower end with a groove 42 opening toward the main shaft 8 and downward. The outer end of the lower frame 7 is inserted into the groove 42 and pivotally connected to the upper hinge portion 4 by means of a hinge pin 47. The groove 42 is provided with a downward extending protrusion 48 at its outer end so that the lower frame 7 is slightly downward inclined relative to a horizontal line when the umbrella 1 is completely extended.

Figure 11A:
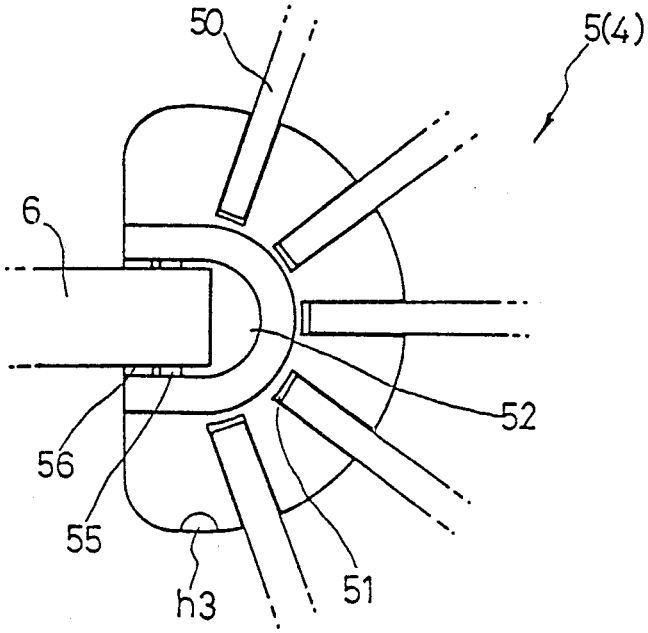
FIG. 11A is a plan view of a lower hinge portion of the invention.
Figure 13A:
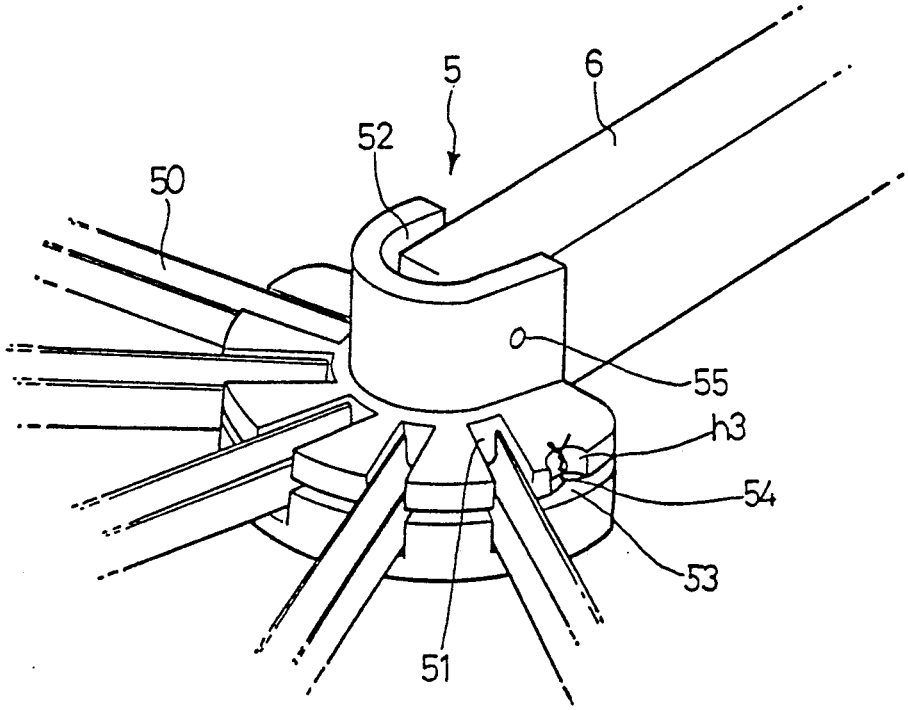
FIG. 13A is a perspective view of a lower hinge portion of the invention.
Figure 13B:
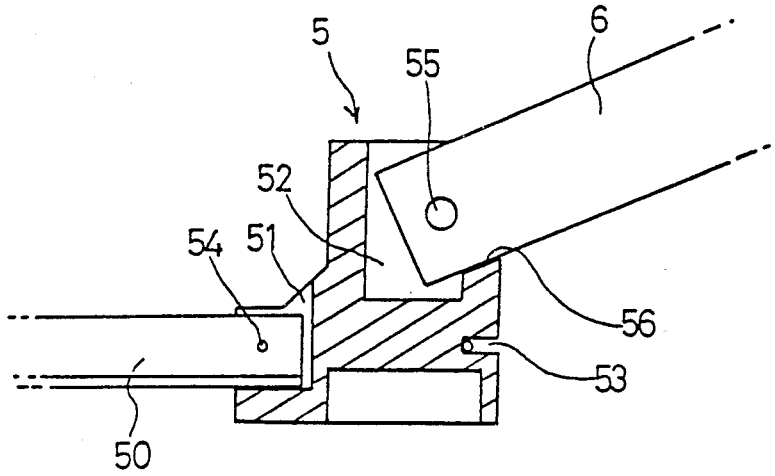
FIG. 13B is a sectional view of FIG. 13A.

Referring to FIGS. 11A, 13A and 13B, there are shown the lower hinge portion 5. As shown in the drawings, the lower hinge portion 5 is formed at its upper end with a groove 52 opening toward the main shaft 8 and upward. The outer end of the upper frame 6 is inserted into the groove 52 and pivotally connected to the lower hinge portion 5 by means of a hinge pin 55. The groove 52 is provided with an upward extending protrusion 56 at its outer end so that the lower frame 6 is slightly upward inclined relative to a horizontal line when the umbrella 1 is completely extended. Also, the lower hinge portion 5 is formed at its outer periphery with a plurality of notches 51 opening outward and upward. The lower hinge portion 5 is formed at its periphery with a wire groove 53 intersecting with the notches 51. The inner ends of the second stretcher links 50 are inserted into the notches 51 and passed through by a hinge wire 54 inserted in the wire groove 53. The knot of hinge wire 54 is concealed in a recess "h3" formed at the periphery of lower hinge portion 5.

Otherwise stated, the oblong umbrella 1 according to an embodiment of the present invention is generally constructed as follows. The upper hub assembly 2 is secured to the upper end of the main shaft 8 and the upper frames 6 and the main spokes 20 are pivotally connected to the upper hub assembly 2 at the inner ends of thereof. Then, the lower runner assembly 3 is inserted on the main shaft 8 and the lower frames 7 and the stretcher links 36 are pivotally connected to the lower runner assembly 3 at the inner ends of thereof. The lower frames 7 are each crossed with the upper frame 6 into a X-shaped configuration and connected to the crossed portion of the upper frame 6 by the pin. The stretcher links 36 are each pivotally connected to the middle portion of the main spoke 20 at its outer end. Thereafter, the lower frames 7 are each pivotally connected to the upper hinge portion 4 at its outer end and the upper frames 6 are each connected to the lower hinge portion 5 at its outer end. The upper hinge portions 4 are each pivotally connected to the second spokes 45 and the lower hinge portions 5 are each pivotally connected to the second stretcher links 50. The second stretcher links 50 are each pivotally connected to the middle portion of the second spoke 45 at its outer end. Finally, the main spokes 20 and the second spokes 45 of the completely extended umbrella 1 are covered with the cloth 9, which has apertures formed at portions corresponding to portions of the cylinder member 22 of the upper hub assembly 2 and the cylinder members 43 of the upper hinge portions 4 respectively, and then the cap 23 and the caps 44 are engaged with the cylinder member 22 and the cylinder members 43 respectively to secure the cloth 9 to the upper hub assembly 2 and the upper hinge portions 4. The cloth 9 is secured to the outer ends of the main and second spokes 20 and 45 at its periphery. Therefore, the secured cloth 9 forms an oblong shape.

Figure 4:
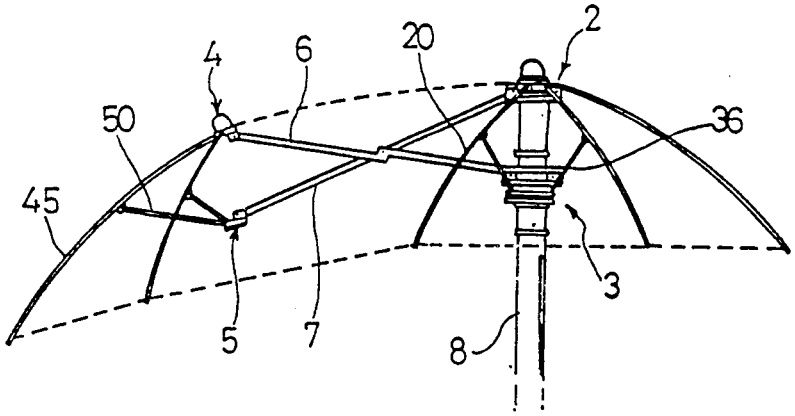
FIG. 4 is a front view of an umbrella according to another embodiment of the invention.
Figure 5:
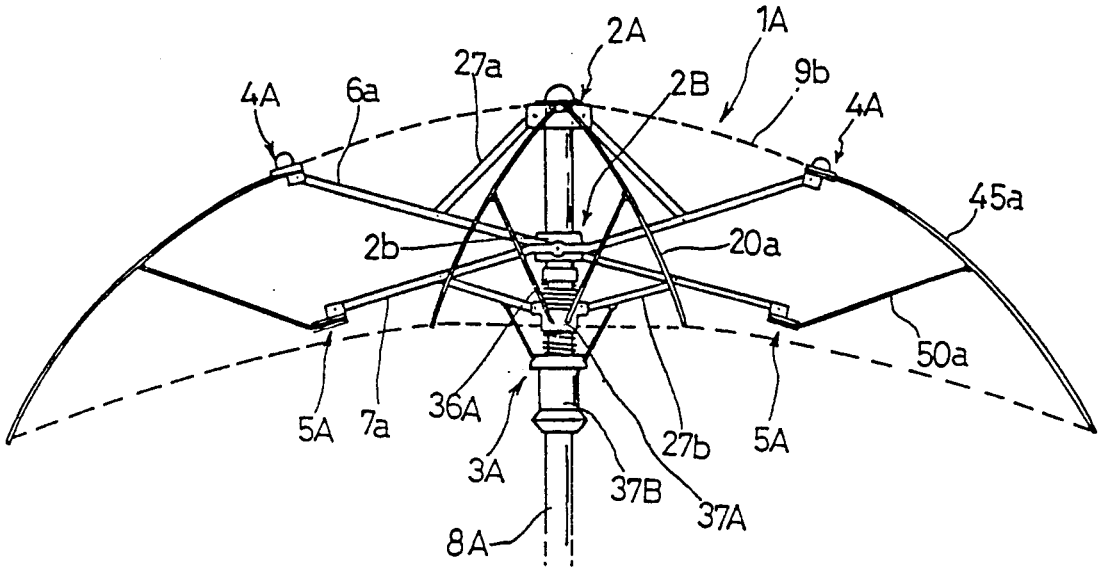
FIG. 5 is a front view of an umbrella according to still another embodiment of the invention.
Figure 6:
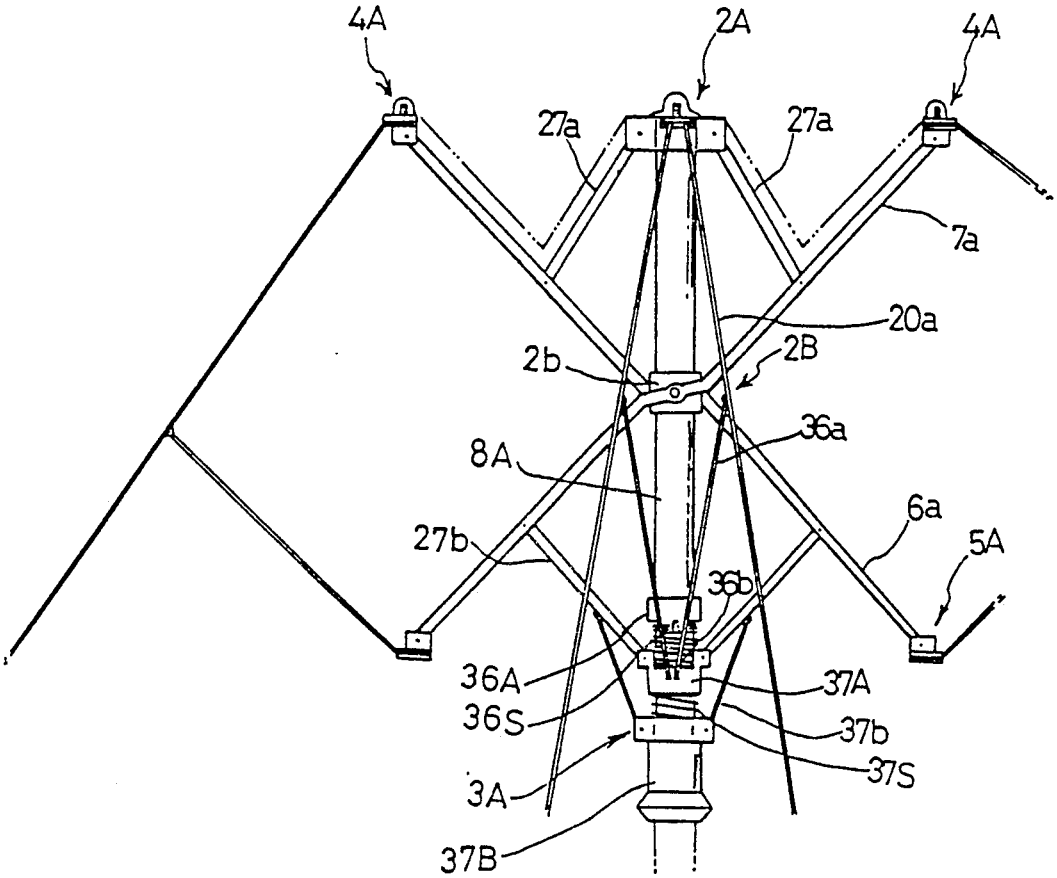
FIG. 6 is an enlarged view of FIG. 5 showing its operation.
Figure 7A:
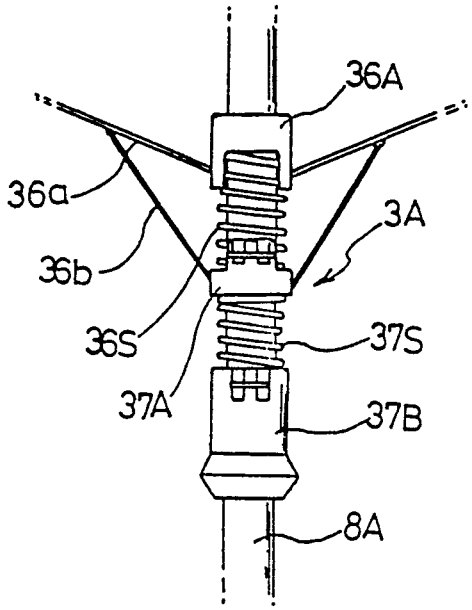
FIG. 7A is a side view of a lower runner assembly of FIG. 5.
Figure 7B:
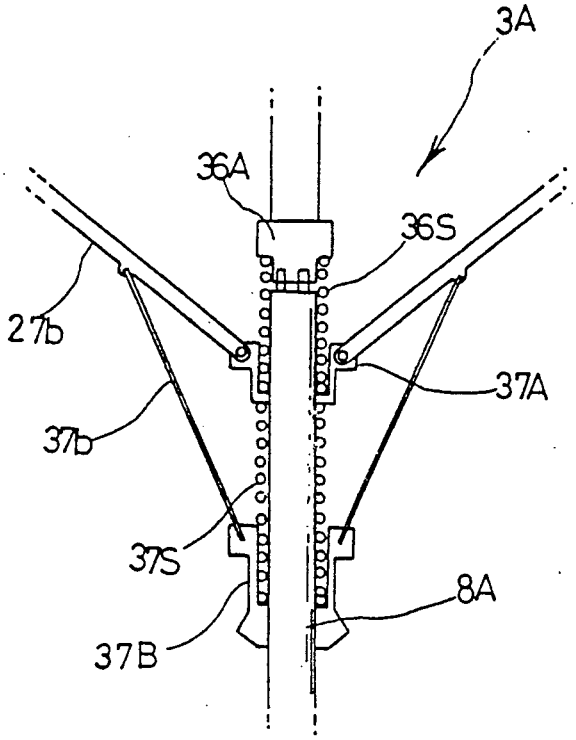
FIG. 7B is a front sectional view of FIG. 7A.

Referring to FIG. 4, there is shown an umbrella according to another embodiment of the present invention. As shown in the drawing, the umbrella is provided on only one side with the upper and lower frames 6 and 7 and the associated components such as the upper and lower hinge portions 4 and 5, the second spokes 45 and the second stretcher links 50 similarly to the first embodiment, and is provided at the other side with only the main spokes 20 and the main stretcher links 36.

Referring also to FIGS. 5 to 7B, there are shown an automatically extendable umbrella according to still another embodiment of the present invention. The umbrella 1A comprises a main straight shaft 8A having a handle (not shown) at its lower end, an upper hub assembly 2A secured to an upper end of the main shaft 8A, a mediate runner 2B slidably inserted on the main shaft 8A under the upper hub assembly 2A, and a lower runner assembly 3A slidably inserted on the main shaft 8A under the mediate runner 2B which has an upper runner 36A, a middle runner 37A and a lower runner 37B.

Two upper stretcher links 27*a* and a plurality of main spokes 20*a* are pivotally connected to the upper hub assembly 2A at inner ends thereof. The two upper stretcher links 27*a* are projected oppositely to each other. A first frame 6*a* and second frames 7*a* are pivotally connected to both sides of the mediate runner 2*b* at middle portions thereof to form a X-shaped configuration and the upper stretcher links 27*a* are each pivotally connected to a middle portion of a half of either of the first and second frames 6*a* and 7*a*.

Main stretcher links 36*a* are each pivotally connected to the upper runner 36A at inner ends thereof and pivotally connected to a middle portion of the main spoke 20*a*. Lower stretcher links 27*b* are each pivotally connected to the middle runner 37A at inner ends thereof and pivotally connected to a middle portion of the other half of either of the first and second frames 6*a* and 7*a*.

Upper sub-links 36*b* are each pivotally connected to the middle runner 37A at inner ends thereof and pivotally connected to a middle portion of the main stretcher link 36*a*. Lower sub-links 37*b* are each pivotally connected to the lower runner 37B at inner ends thereof and pivotally connected to a middle portion of the lower stretcher link 27*b*. An upper compression spring 36S is interposed between the upper runner 36A and the middle runner 37A and a lower compression spring 37S is interposed between the middle runner 37A and the lower runner 37B.

Upper hinge portions 4A are each pivotally connected to an end of the half of either of the first and second frames 6*a* and 7*a* and to inner ends of a plurality of second spokes 45*a*. Lower hinge portions 5A are each pivotally connected to an end of the other half of either of the first and second frames 6*a* and 7*a* and to inner ends of second stretcher links 50*a* each pivotally connected to a middle portion of the second spoke 45*a*. An oblong cloth 9*b* is secured to outer ends of the main and second spokes 20*a* and 45*a* at its outer periphery.

Similarly to the first and second embodiments, the upper hub assembly 2A and the hinge portions 4A will be coupled to caps (not shown) respectively.

Figure 14A:
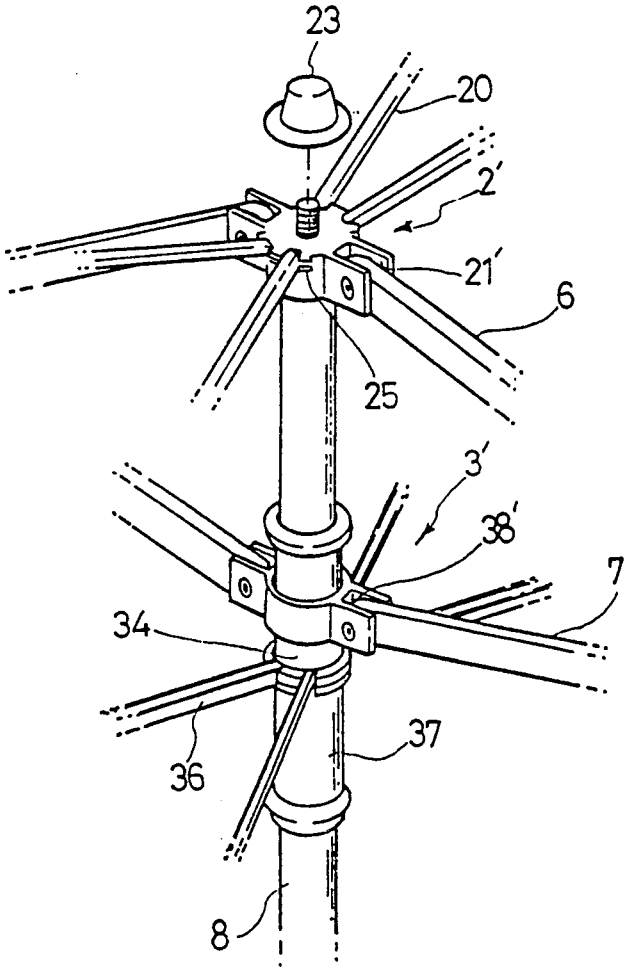
FIG. 14A is a perspective of an upper hub assembly and a lower runner assembly according to another embodiment of the invention.

In above-described embodiments, the upper hub assembly and the lower runner assembly may have another structure, as shown in FIG. 14A. That is, the upper hub assembly 2' shown in the drawing has a modified grooves 21' opening upward as well as outward and downward but has not the wire grooves "H" and the recess "h" (see FIG. 8A). Also, the lower runner assembly 3' shown in the drawing has a modified grooves 38' opening upward as well as outward and downward but has not the wire groove "H1" and the recess "h1" (see FIG. 8B).

Figure 14B:
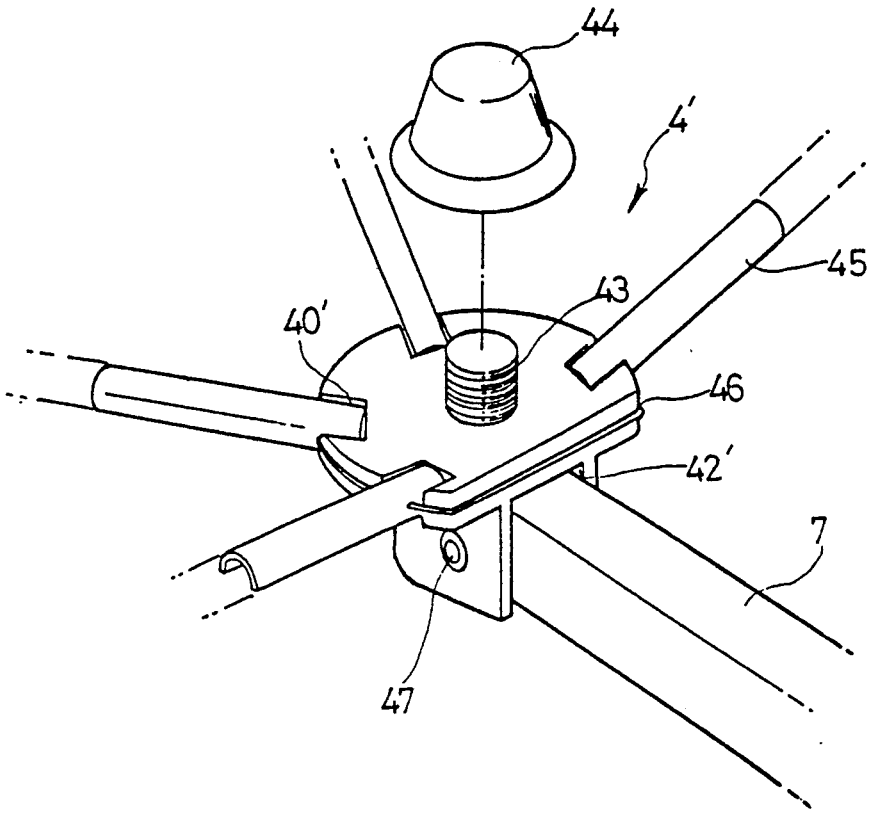
FIG. 14B is a perspective view of an upper hinge portion according to another embodiment of the invention.
Figure 14C:
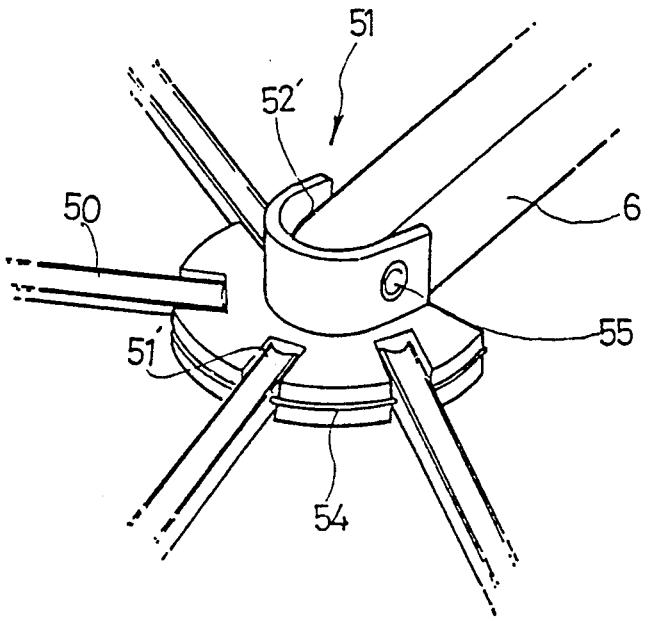
FIG. 14C is a perspective view of a lower hinge portion according to another embodiment of the invention.

In addition, the upper hinge portion and the lower hinge portion may also have another structure, as shown in FIGS. 14B and 14C. That is, the upper hinge portion 4' shown in FIG. 14B has a modified groove 42', in which the downward extending protrusion 48 is not provided, and modified grooves 40' opening upward as well as outward and downward but does not have the wire groove 41 and the recess "h2" (see FIGS. 12A and 12B). Also, the lower hinge portion 5' shown in FIG. 14C has a modified groove 52', in which the upward extending protrusion 56 is not provided, and modified grooves 51' opening downward as well as outward and upward but does not have the wire groove 53 and the recess "h3" (see FIGS. 13A and 13B).

The above-described modified umbrella is somewhat deteriorated in its operating efficiency as compared with the previous embodiments but applicable to cheaper products.

Figure 11B:
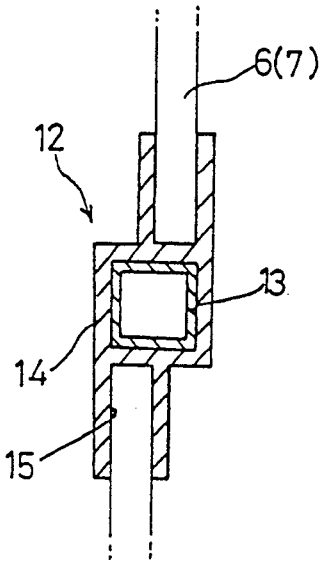
FIG. 11B is a top sectional view of a main shaft of the invention which has a square section.

Furthermore, the main shaft of the present invention may have a square section, as shown in FIG. 11B. In accordance with the square sectional main shaft 13, an upper hub assembly or a lower runner assembly 12 also comprises a square sectional pipe 14 having a guide hole corresponding to the square sectional main shaft 13. Therefore, the upper hub assembly or the lower runner assembly 12 can not be rotated relative to the main shaft 13. Also, the square sectional pipe 14 of the upper hub assembly or the lower runner assembly 12 is formed at its both sides with two grooves 15 into which the upper frame 6 or the lower frame 7 is inserted. The grooves 15 are deviated from each other. A groove 15 formed at a side of the upper hub assembly is deviated from a groove 15 formed at the side of the lower runner assembly so that the upper frame 6 connected to the groove of the upper hub assembly and the lower frame 7 connected to the groove of the lower runner assembly are not twisted but arranged in parallel.

The operation of the above-mentioned constructions according to the embodiments of the present invention will now be described.

In case of the first embodiment shown in FIGS. 2, 3, 8A, 8B and 9, as the lower runner assembly 3 is raised along the main shaft 8, the stretcher links 36 connected to the lower runner assembly 3 raise the main spokes 20 so as to be extended outwardly. At the same time, the upper frames 6 and the lower frames 7 are also extended outwardly so that the lower hinge portions 5 connected to the outer ends of the upper frames 6 are raised to approach the upper hinge portions 4 connected to the outer ends of the lower frames 7, thereby causing the second spokes 45 to be raised by the raised second stretcher links 50. Therefore, the cloth 9 secured to the outer ends of the main and second spokes 20 and 45 is spread out into an oblong shape of a top view thereof.

In this case, since the upper hinge portions 4 are portioned slightly under a horizontal line of the upper hub assembly 2, the cloth 9 forms a crescent shape when viewed from front. Also, since the cloth 9 is pulled outwardly by the main and second spokes 20 and 45, the cloth 9 is spread out into a tightly rounded shape in its upper surface.

When the umbrella 1 is folded, the sub-runner 30 is in contact with the main runner 31. As the umbrella 1 is spread out and folded, the sub-runner 30 is slidably moved upward and downward along the guide rails 34*a* of the main runner 31 at its guide grooves 33*a*. Therefore, a relative orientation of the sub-runner 30 to the main runner 31 does not change during the upward and downward movement of the sub-runner 30, thereby preventing the sub-runner 30 from being rotated relative to the main runner 31 (see FIGS. 8B, 9 and 10).

When the umbrella is completely extended, each of the upper frames 6 and each of the lower frames 7 define a X-shaped configuration of a predetermined angle because the upper frame 6 is supported by an upper inclined ceilings of the groove 21 of the upper hub assembly 2 at its inner end (see FIG. 8A) and the lower frame 7 is supported by an inclined bottom of the groove 38 of the sub-runner 30 at its inner end (see FIG. 8B).

Since the upper frame 6 is inserted in the groove 52 and supported by the upward extending protrusion 56 of the lower hinge portion 5 at its outer end when the umbrella is extended, the lower hinge portion 5 can not be inclined and twisted (see FIG. 13A). Also, since the lower frame 7 is inserted in the groove 42 and supported by the downward extending protrusion 48 of the upper hinge portion 4 at its outer end when the umbrella is extended, the upper hinge portion 4 is not inclined and twisted and also serves to spread out the cloth 9 into an accurate oblong shape.

In addition, since the main spokes 20 and the second spokes 45 are supported by upper inclined ceilings of the grooves 24 of the upper hub assembly 2 and the grooves 40 of the upper hinge portions 4 at inner ends thereof respectively (see FIGS. 8A and 12A) and the main and second stretcher links 36' and 50 are supported by the lower runner assembly 3 and the lower hinge portions 5 similarly to the spokes 20 and 45 when the umbrella is extended, the main and second spokes 20 and 45 serve to spread out tightly the cloth 9 and to cause the cloth 9 to form an accurate oblong shape.

When the umbrella 1 is folded by pushing the locker plate 10, as the lower runner assembly 3 is moved downward along the main shaft 8, the stretcher links 36 pull the main spokes 20 inwardly. At the same time, the upper and lower frames 6 and 7 are retracted toward the main shaft 8 so that the upper and lower hinge portions 4 and 5 are widened from each other, thereby causing the second spokes 45 to be pulled toward the main shaft 8. The umbrella 1 which has been completely folded has a shape and a volume similar to those of a conventional umbrella but the umbrella which has been completely extended has a doubled area of the cloth 9 as compared with a conventional umbrella.

Since the grooves 21 of the upper hub assembly 2 and the grooves 38 of the sub-runner 30 are provided with the upper ceilings and the bottoms, the upper and lower frames 6 and 7 can support the upper and lower hinge portions 4 and 5 and the associated component even when the umbrella 1 is loaded with strong external force.

Also, since the upper frame 6 connected to a side of the upper hub assembly 2 is deviated from the lower frame 7 connected to the side of the lower runner assembly 3 when viewed from a top view thereof as shown in FIG. 10, the upper and lower frames 6 as well as 7 and the upper and lower hinge portions 4 and 5 can not be twisted each other.

When the main shaft 8 is constructed into a square sectional shape as shown in FIG. 11B, the upper hub assembly 2 and the lower runner assembly 3 can not be rotated relative to the main shaft 8 and also a relative orientation of the lower runner assembly 3 to the upper hub assembly 2 can be accurately achieved. Moreover, when the umbrella is applied to a beach umbrella, the umbrella can be fixedly mounted on a table.

Operation of the second embodiment of the invention is similar to a conventional umbrella at one side thereof but similar to the first embodiment of the invention at the other side thereof. Therefore, the umbrella according to the second embodiment of the invention is efficient when the umbrella is used for shielding two people or for shielding one person carrying a pack on his shoulder by portioning the projected cloth part of the umbrella over the pack.

In case of the automatically extendible umbrella according to the third embodiment of the invention, upon pushing a locker mounted on a handle (not shown), the lower runner assembly 3A is slidably moved upward along the main shaft 8A by an elastic force of the upper and lower compression spring 36S and 37S. At this time, the main stretcher links **36*a* raise the main spokes 20*a* to be extended. At the same time, since the lower stretcher links 27*b* raises the first and second frame 6*a* and 7*a* connected to the mediate runner 2B to form a X-shaped configuration, the first and second frame 6*a* and 7*a* are extended outwardly while being guided by the upper and lower stretcher links 27*a* and 27*b*. As the first and second frames 6*a* and 7*a* are extended, the second stretcher links 50*a* raise the second spokes 45*a* to be extended. Therefore, the cloth 9*b* covering on the spokes 20*a* and 45*a*** is spread out into an oblong shape.

As apparent from the above-description, since the lower runner assembly raises the main spokes and also extends the frames to cause the second spokes to be raised when the umbrella of the invention is extended, the cloth of the umbrella is tightly spread out into an oblong shape projecting oppositely. Also, since the upper hinge portions are located under a horizontal line of the upper hub assembly when the umbrella is extended, the cloth has a crescent shape when viewed from a front view thereof.

The umbrella is considerably reduced in its weight as compared with its large size and has an oblong cloth projecting toward its both sides, thereby improving performance for an umbrella and a beach umbrella.

Furthermore, the spokes of the invention can maintain own portions thereof and can not be easily damaged by means of characteristic structures of the upper hub assembly, the lower runner assembly and the upper and lower hinge portions of the invention.

It must be understood that many alterations and modifications may be made by those having ordinary skill in the art to the structures disclosed herein without departing from the spirit and scope of the invention. Therefore, the presently illustrated embodiments have been shown only by way of example and should not be taken to limit the scope of the following claims.

What is claimed is:

1. An oblong umbrella comprising:

a main straight shaft having upper and lower ends and a handle at its lower end;

two upper frames, each having an inner end, an intersected portion, and an outer end;

two lower frames, each having an inner end and an outer end;

a plurality of main spokes, each having a middle portion and an inner end;

a plurality of stretcher links, each having an inner end;

a plurality of second spokes, each having an inner end and an outer end;

a plurality of second stretcher links, each having an inner end and a middle portion;

an upper hub assembly secured to the upper end of the main shaft which is pivotally connected to the inner ends of the two upper frames projecting oppositely therefrom and pivotally connected to the inner ends of the main spokes;

a lower runner assembly which has a main runner slidably inserted on the main shaft and a sub-runner slidably inserted on the main runner, the main runner being pivotally connected to the inner ends of the plurality of stretcher links and the subrunner being pivotally connected to the inner ends of the two lower frames projecting oppositely therefrom, the stretcher links being pivotally connected to middle portions of the main spokes, each of the lower frames being intersected with each of the upper frames to form X-shaped configuration and connected to the intersected portion of the upper frames by means of a hinge pin;

upper hinge portions each of which is pivotally connected to an outer end of a lower frame and to inner ends of a plurality of second spokes;

lower hinge portions each of which is pivotally connected to an outer end of a upper frame and to inner ends of a plurality of second stretcher links, the second stretcher links being pivotally connected at the outer end thereof to the middle portions of the second spokes; and an oblong cloth secured at its outer periphery to the outer ends of the main spokes and the second spokes.

2. An oblong umbrella in accordance with claim 1, wherein said upper hub assembly is provided with upper and lower horizontal projections at its both sides and formed at its both ends with grooves opening outward and downward, the upper frames being inserted in the grooves and pivotally connected to the upper hub assembly at inner ends thereof, the upper projections are formed at outer periphery thereof with a plurality of second grooves opening outward and downward, a wire groove crossing with the second grooves and a recess, and the plurality of main spokes are inserted in the plurality of second grooves and pivotally connected to the upper projections at inner ends thereof by means of a wire passing through the wire groove, the knot of wire being concealed and fixed in the recess.

3. An oblong umbrella in accordance with claim 1, wherein said lower runner assembly comprises:

the main runner having an upper guide cylinder and a lower guide cylinder which is formed at its both ends with a plurality of grooves opening outward and upward and at it outer periphery with a wire groove crossing with the grooves and a recess, the plurality of stretcher links being inserted in the grooves at inner ends thereof and pivotally connected to the main runner by means of a wire passing through the wire groove, the knot of wire being concealed and fixed in the recess, the upper guide cylinder being provided with one or more of longitudinal guide rail at its outer surface;

the sub-runner slidably inserted on the upper guide cylinder which has second grooves opening outward and upward at its both ends and a central guide hole corresponding to the upper guide cylinder, the lower frames being inserted in the second grooves at inner ends thereof and pivotally connected to the sub-runner, the central guide hole being formed with one or more of longitudinal guide groove corresponding to the guide rail such that the lower frames are crossed with the stretcher links when the sub-runner is inserted on the upper guide cylinder; and a retaining ring coupled to an upper end of the upper guide cylinder to prevent the sub-runner from being separated from the main runner.

4. An oblong umbrella in accordance with claim 1, wherein said umbrella has only the main spokes and stretcher links at a side thereof.

5. An oblong umbrella in accordance with claim 1, wherein said upper hinge portions each is formed at its outer periphery with a plurality of grooves opening outward and downward, a wire groove crossing with the grooves and a recess and at its lower end with a second groove opening toward the main shaft and downward, the second spokes being inserted at inner ends thereof in the grooves and pivotally connected to the upper hinge portion by means of a wire passing through the wire groove, the knot of wire being concealed and fixed in the recess, the lower frames being inserted at outer ends thereof in the second groove and pivotally connected to the upper hinge portion.

6. An oblong umbrella in accordance with claim 1, wherein said lower hinge portion each is formed at its upper end with a groove opening toward the main shaft and upward and at its outer periphery with a plurality of second grooves opening outward and upward, a wire groove crossing with the second grooves and a recess, the upper frames being inserted at outer ends thereof in the groove and pivotally connected to the lower hinge portion, the second stretcher links being inserted at inner ends thereof in the second grooves and pivotally connected to the lower hinge portion by means of a wire passing through the wire groove, the knot of wire being concealed and fixed in the recess.

7. An oblong umbrella in accordance with claim 1, said main shaft has a square section and said upper hub assembly and the lower runner assembly have square sectional central holes corresponding to the main shaft respectively.

8. An oblong umbrella comprising:

a main straight shaft having upper and lower ends and a handle at its lower end;

a plurality of main spokes, each having a middle portion and an inner end;

a plurality of second spokes, each having an inner end and a middle portion;

a plurality of main stretcher links, each having an inner end;

a plurality of upper stretcher links, each having an inner end;

a first frame and a second frame, each having a middle portion, an upper half and a lower half, each respective half having a middle portion;

an upper hub assembly secured to the upper end of the main shaft which is pivotally connected to the inner ends of the two upper stretcher links and to the plurality of main spokes, the two upper stretcher links projecting oppositely to each other;

a mediate runner slidably inserted on the main shaft under the upper hub assembly, said runner having two sides, said sides respectively being pivotally connected to the middle portions of the first and second frames, the upper stretcher links each being pivotally connected to a middle portion of an upper half of either of the first and second frames;

a lower runner assembly slidably inserted on the main shaft under the mediate runner which is pivotally connected to the inner ends of the main stretcher links, each pivotally connected to a middle portion of a main spoke, the lower runner assembly further being pivotally connected to the inner ends of the lower stretcher links, said lower stretcher links each being pivotally connected to a middle portion of the lower half of either of the first and second frames;

upper hinge portions each of which is pivotally connected to an end of the upper half of either of the first and second frames and to a plurality of the second spokes;

lower hinge portions each of which is pivotally connected to an end of the lower half of either of the first and second frames and to a plurality of the second stretcher links, each said second stretcher link being pivotally connected to a middle portion of a second spoke; and an oblong cloth secured at its periphery to the outer ends of the main and the second spokes.

9. An oblong umbrella in accordance with claim 8, wherein said main shaft has a square section and said upper hub assembly, the mediate runner and the lower runner assembly have square sectional central holes corresponding to the main shaft respectively.

10. An oblong umbrella in accordance with claim 8, wherein said lower runner assembly comprises an upper runner, a middle runner, a lower runner, an upper compression spring interposed between the upper runner and the middle runner and a lower compression spring interposed between the middle runner and the lower runner, the upper runner being pivotally connected to inner ends of main stretcher links, the middle runner being pivotally connected to inner ends of lower stretcher links and to inner ends of upper sub-links each pivotally connected to a middle portion of the main stretcher link, the lower runner being pivotally connected to inner ends of lower sub-links each pivotally connected to a middle portion of the lower stretcher link.

* * * * *